US006241221B1

(12) United States Patent
Wegner et al.

(10) Patent No.: US 6,241,221 B1
(45) Date of Patent: Jun. 5, 2001

(54) WASTE POND LIQUID CIRCULATION SYSTEM HAVING AN IMPELLER AND SPACED PONTOONS

(75) Inventors: Gary L. Wegner; Anne C. Goggin, both of Reardan, WA (US)

(73) Assignee: Natural Aeration, Inc., Reardan, WA (US)

( * ) Notice: Subject to any disclaimer, the term of this patent is extended or adjusted under 35 U.S.C. 154(b) by 0 days.

(21) Appl. No.: 09/464,673

(22) Filed: Dec. 15, 1999

Related U.S. Application Data

(63) Continuation-in-part of application No. 09/083,862, filed on May 21, 1998, now abandoned.

(51) Int. Cl.[7] ..... B01F 3/04
(52) U.S. Cl. ..... 261/93; 261/120
(58) Field of Search ..... 261/91, 93, 120; 210/219, 242.2

(56) References Cited

U.S. PATENT DOCUMENTS

| | | | |
|---|---|---|---|
| 3,865,721 | 2/1975 | Kaelin | 261/91 |
| 4,681,711 | 7/1987 | Eaton | 261/91 |
| 4,764,313 | 8/1988 | Cameron et al. | 261/35 |

FOREIGN PATENT DOCUMENTS

| | | | |
|---|---|---|---|
| 2398024 | 3/1979 | (FR) | 261/120 |
| 986869 | 1/1983 | (RU) | 261/91 |

OTHER PUBLICATIONS

Sunset Solar Systems Ltd., "Little River Pond Mills Enviro 201 Manual—Electric Pond Mill," cover page and pp. 3, 9, 10, 16, Mar. 25, 1997.

Sunset Solar Systems Ltd., "Little River Pond Mills Enviro 202 Manual—Electric Pond Mill," on sale prior to May 20, 1997.

Sunset Solar Systems Ltd., "Little River Pond Mills Model Enviro 400 Operators Manual—Deluxe Tall Mast Pond Mill," Revised Feb. 1992, cover page.

Aeromix Systems, Incorporated brochure "Tornado—A High –Efficiency, Horizontally Mixing, Aspirating Aerator," Bulletin 152, on sale prior to May 20, 1997.

South Carolina Farmer, "Hog producer finds an odor–eater," Sep. 1996. p. 18.

Aeromix Systems, Incorporated brochure, "Make Your Neighbors Happy—Manure Storage Odor Control Solution," on sale prior to May 20, 1997.

*Primary Examiner*—David A. Simmons
*Assistant Examiner*—Robert A. Hopkins
(74) *Attorney, Agent, or Firm*—Wells, St. John, Roberts, Gregory & Matkin, P.S.

(57) ABSTRACT

A waste pond liquid circulator is described in which a plurality of pontoons extend substantially radially from a base and with respect to a central axis passing through the base. A drive mechanism is mounted on the base that is drivingly connected to an impeller for rotating the impeller about the central axis. The base and pontoons are configured to rest on a liquid surface with the pontoons engaging the liquid and forming wedge shaped spaces between successive pontoons. The impeller is rotated by the drive mechanism about the central axis to produce a vortex current of liquid directed toward the it base. The pontoons are configured to receive and direct the current substantially radially away from the base through the wedge shaped spaces.

25 Claims, 10 Drawing Sheets

WASTE POND LIQUID CIRCULATION SYSTEM HAVING AN IMPELLER AND SPACED PONTOONS

RELATED APPLICATIONS

The present application is a continuation-in-part of U.S. patent application, Ser. No. 09/083,862 filed on May 21, 1998, abandoned.

TECHNICAL FIELD

The present invention relates to mechanical circulation of liquids particularly in aquatic liquid waste collection and recycling systems such as collecting ponds, waste stabilization ponds, lagoons and the like.

BACKGROUND OF THE INVENTION

It has been known that aeration of fluids in standing liquid waste ponds, collection basins, and the like serves to introduce fresh oxygen into the liquid, thereby encouraging aerobic activity. Aerobic bacteria can thus function within the oxygenated fluid to break down organic materials. Otherwise, a stagnant pond will function substantially only with anaerobic breakdown of sludge. Anaerobic activity results in the release of gasses that produce an extremely noxious smell about the vicinity of the pond. Further, anaerobic activity by itself is an inefficient process for breaking down organic solids. Aerobic bacteria, on the other hand work 4 to 6 times faster than anaerobic bacteria at normal liquid temperatures of 50° Fahrenheit. Anaerobic bacteria work best at liquid temperatures of 100° Fahrenheit. Plus, the gasses normally vented to the atmosphere during anaerobic breakdown are substantially eliminated during aerobic activity.

In an attempted solution to the problem of introducing effective aerobic breakdown, aerators have been developed for placement on pond surfaces to force oxygen into the pond fluids. Some of the surface aeration equipment include impellers that are used to circulate the liquids near the pond surface. The circulating fluids will be exposed to free air at the pond surface and aerobic activity is thereby increased. More sophisticated systems force air into the pond fluids, again at or near the surface. While this further increases oxygen content, only the upper strata of the fluid material is affected and anaerobic activity still occurs in the major portions of the lower levels of the pond including the sludge at the bottom.

It is an objective of the present invention to provide a liquid circulation system that is useful to encourage aerobic bacterial decomposition to a greater depth than presently known forms of surface aeration systems.

The above and further objects and advantages will become apparent from the following description which, taken with the accompanying drawings, exemplify a preferred mode of the present invention.

BRIEF DESCRIPTION OF THE DRAWINGS

Preferred embodiments of the invention are described below with reference to the following accompanying drawings.

FIG. 7 is an enlarged side elevation view of the FIG. 6 embodiment with a drive cover shown in dashed lines;

DETAILED DESCRIPTION OF THE PREFERRED EMBODIMENTS

Figure 1:
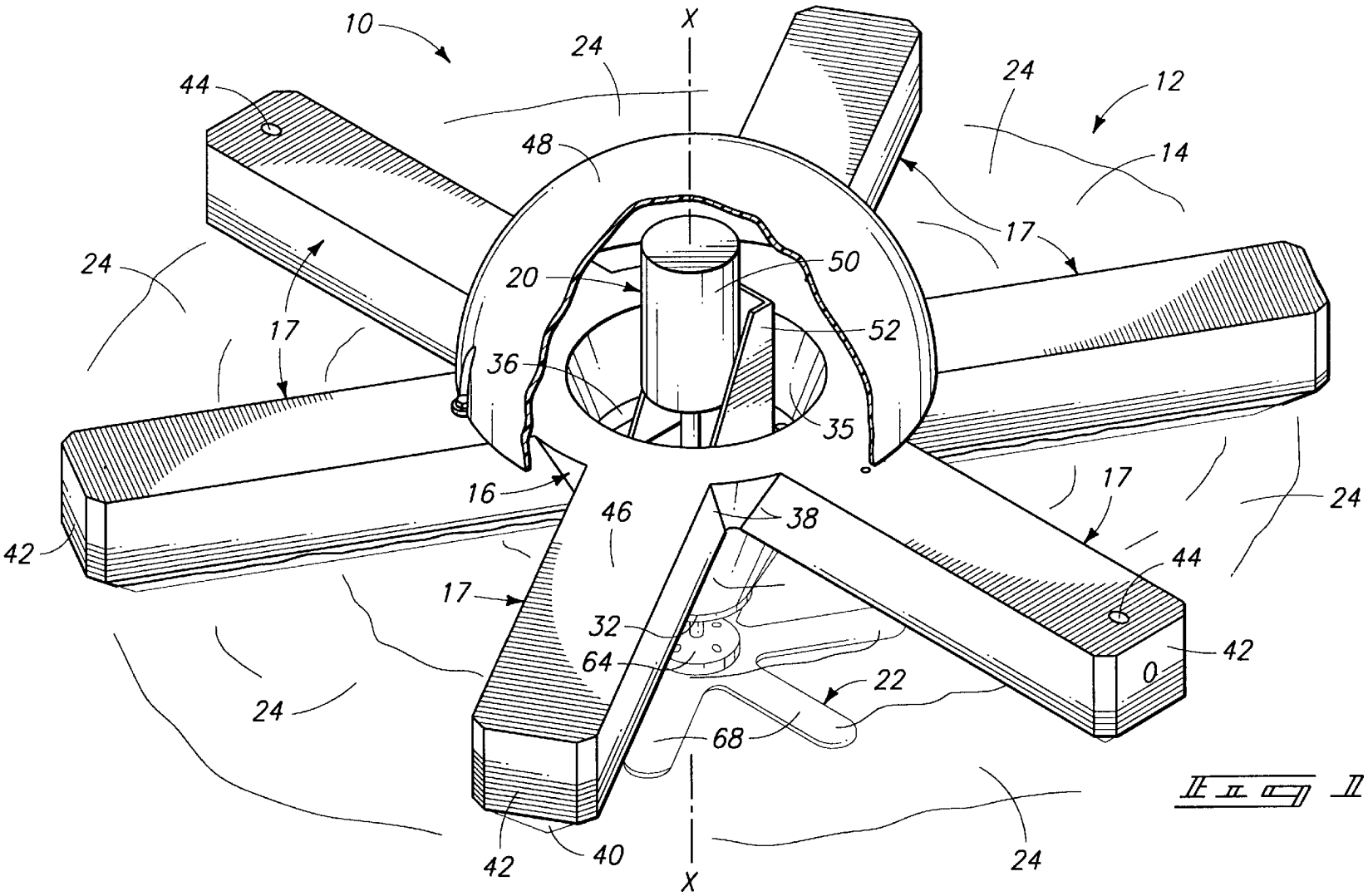
FIG. 1 is a perspective, partially fragmented view of an exemplary preferred liquid circulation system.

This disclosure of the invention is submitted in furtherance of the constitutional purposes of the U.S. Patent Laws "to promote the progress of science and useful arts" (Article 1, Section 8).

Examples of preferred forms of the present waste pond liquid circulator system are generally identified in the drawings by the reference numeral 10. Each system 10 is intended to be placed primarily in an aquatic systems that involve a "pond" (an example being graphically illustrated at 12 in FIG. 2) which is generally defined herein as a body of liquid 14 having a top liquid surface 13 and a pond bottom 15. Examples of such "ponds" systems include recycling ponds, collecting ponds, waste stabilization ponds, waste treatment ponds, lagoons and the like.

In preferred embodiments, the present system 10 operates to aerate the liquid 14 and provide a viable environment for aerobic breakdown of organic materials that may be suspended or in solution in the liquid. This is done by producing a current within the liquid that will circulate substantially as shown by the arrows in FIGS. 2 and 6.

Figure 6:
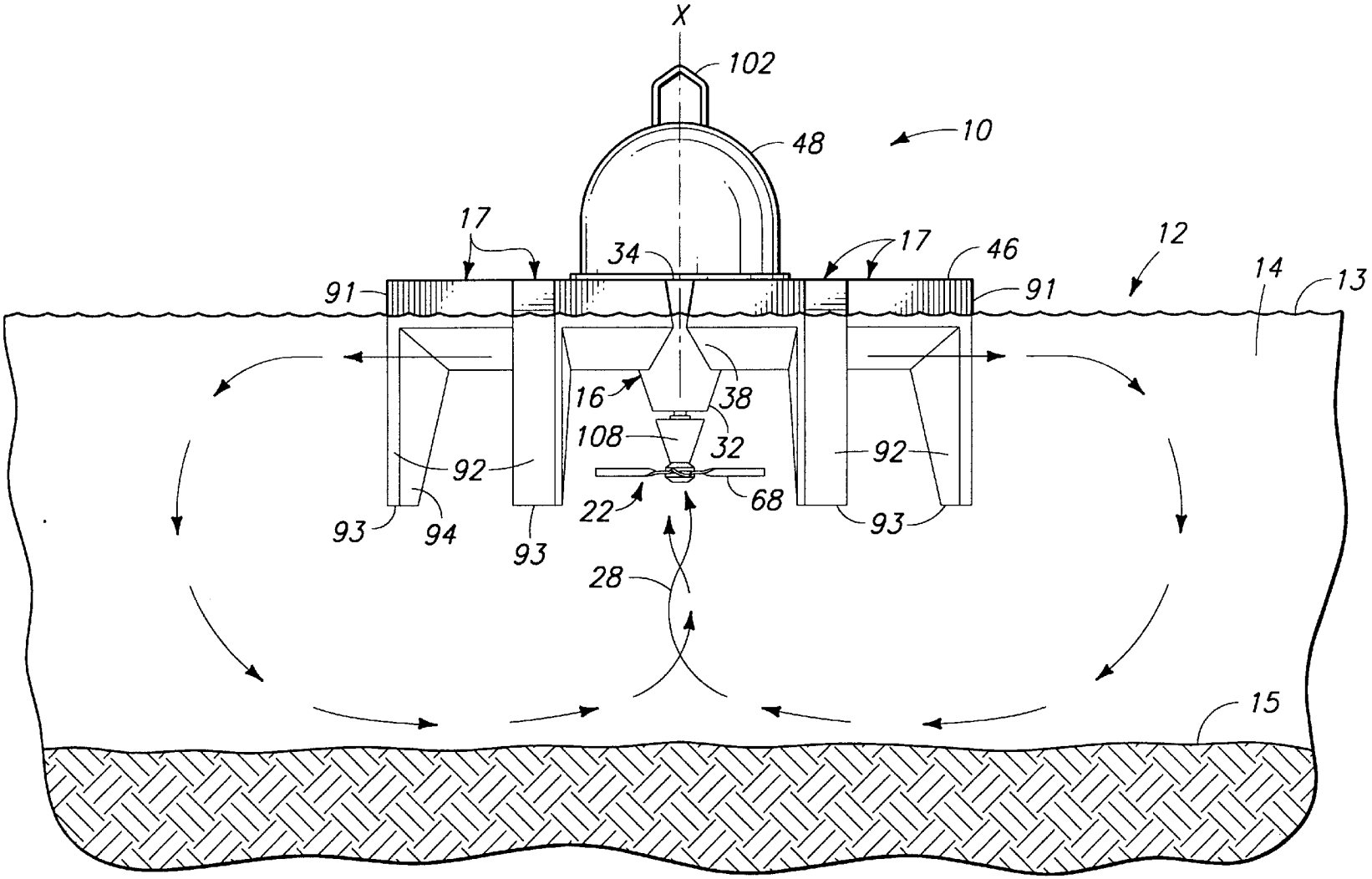
FIG. 6 is a perspective, partially fragmented view of another preferred liquid circulation system.

Referring to preferred forms of the present circulator 10, reference is made in general to FIGS. 1 and 6. In both embodiments, a plurality of pontoons 17 converge at a common base 16. The pontoons are oriented in a substantially radial arrangement with respect to a central axis X passing through the base. It is preferred that the pontoons 17 and base 16 be integral.

A drive mechanism 20 is provided on each form of the base 16. An impeller 22 is connected to the drive mechanism 20 for rotation about the central axis X. The impeller 22 is configured to be rotated by the drive mechanism 20 about the central axis X to produce a vortex current 28 (diagrammatically shown by the arrows in FIGS. 2 and 6) of liquid directed toward the base 16.

Figure 3:
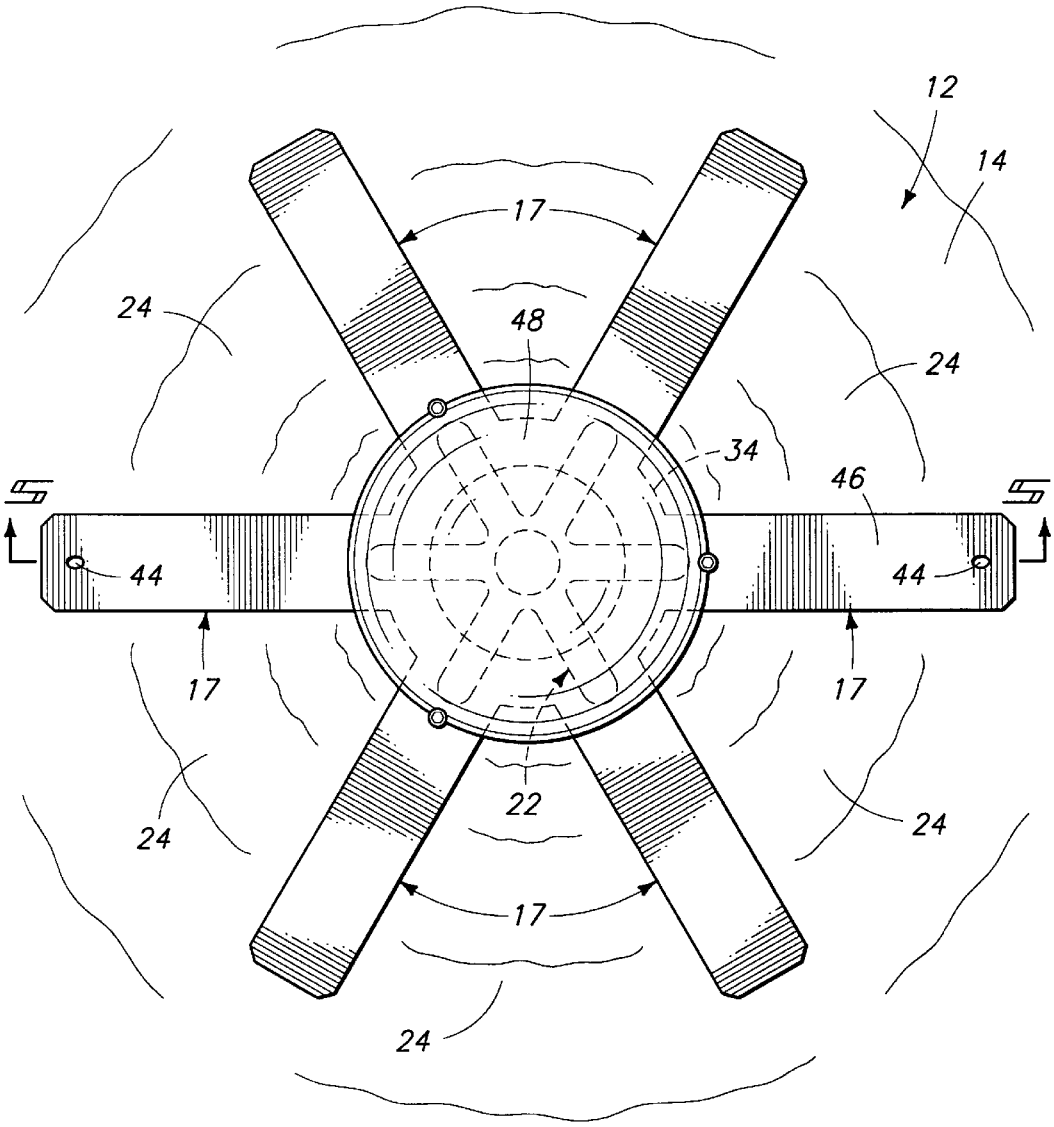
FIG. 3 is a top plan view as seen from above in FIG. 2.
Figure 4:
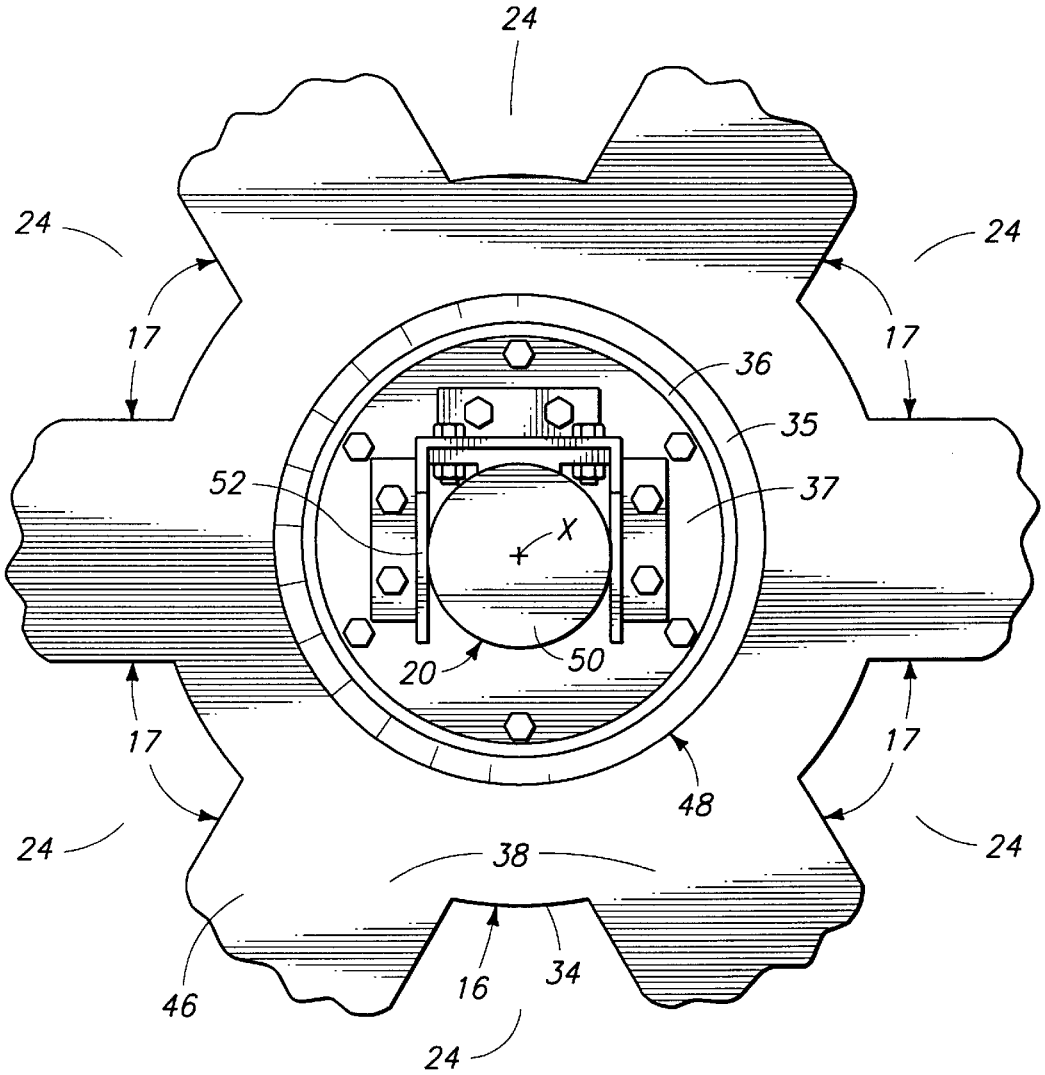
FIG. 4 is an enlarged fragmentary plan view showing details of an exemplary drive mechanism and mount.

The base 16 and pontoons 17 are configured to rest on a liquid If surface with the pontoons 17 engaging and floating on the liquid. The pontoons form wedge shaped spaces 24 (FIG. 3) between successive pontoons 17. The pontoons 17 are configured to direct the vortex current 28 radially away from the base through the wedge shaped spaces 24.

Figure 2:
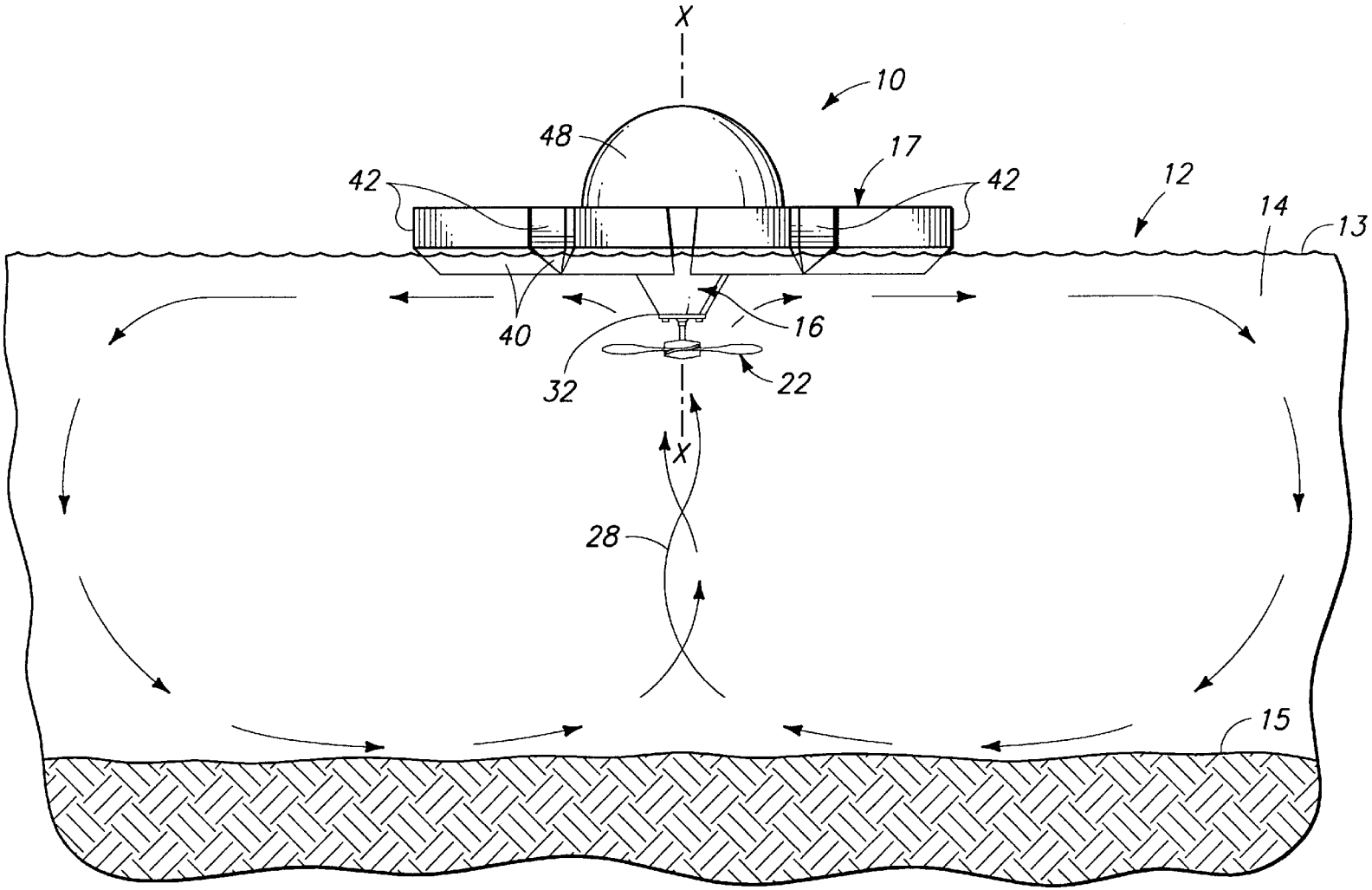
FIG. 2 is a diagrammatic view illustrating operation of the system shown in FIG. 1.

In preferred forms, the base 16 and the pontoons 17 are integral. In the most preferred forms, the base 16 and pontoons 17 are formed as a unit, preferably of a durable molded plastic such as linear polyethylene. Rotation molding has been successfully used to form the integrated base and pontoons. This process may also be used to encase an airspace 30 (FIG. 5) within the confines of the base 16 and pontoons 17 that will function as flotation for the circulator system 10, generally as shown in FIGS. 1, 2, and 6.

Figure 10:
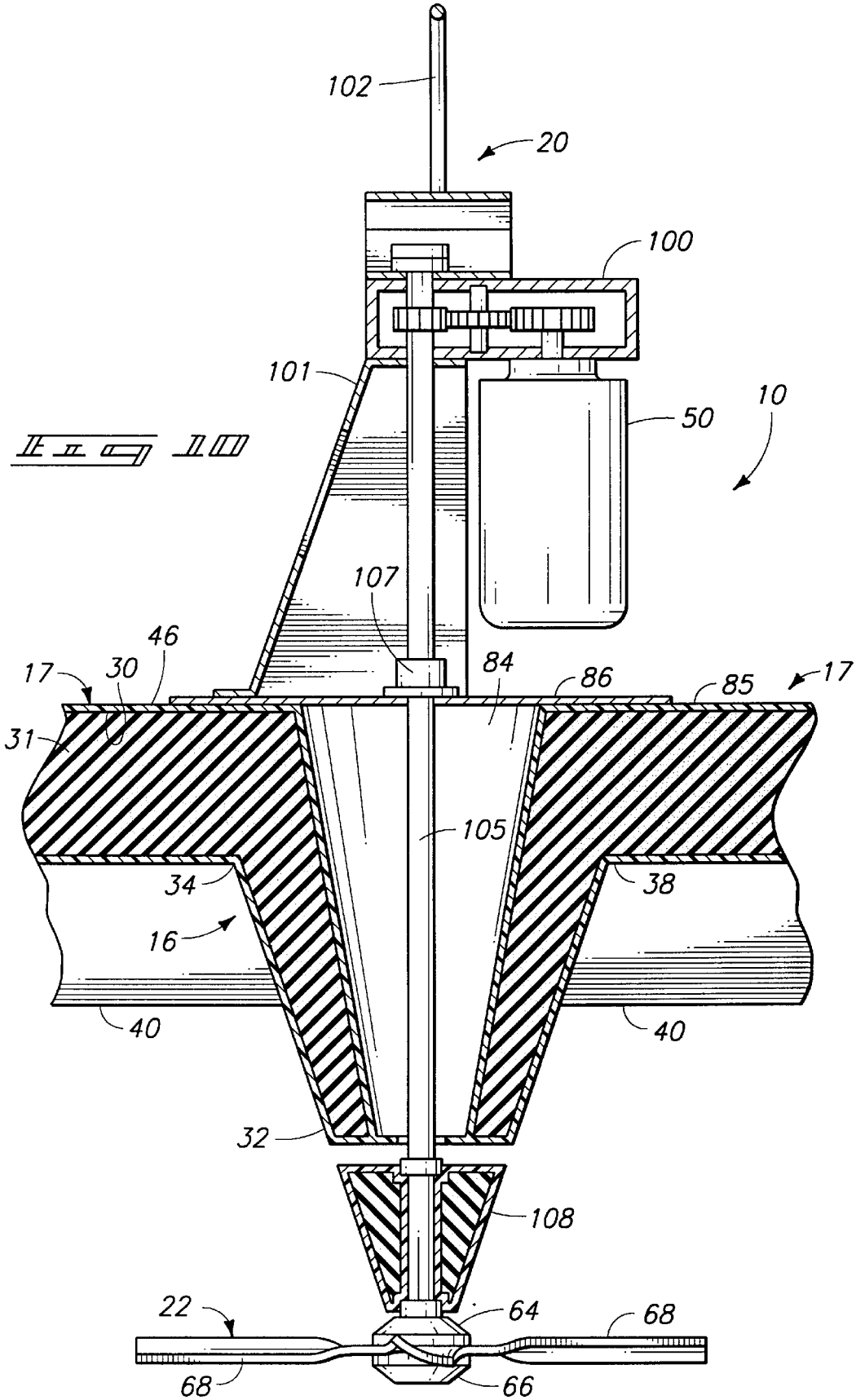
FIG. 10 is an enlarged fragmented sectional view.
Figure 11:
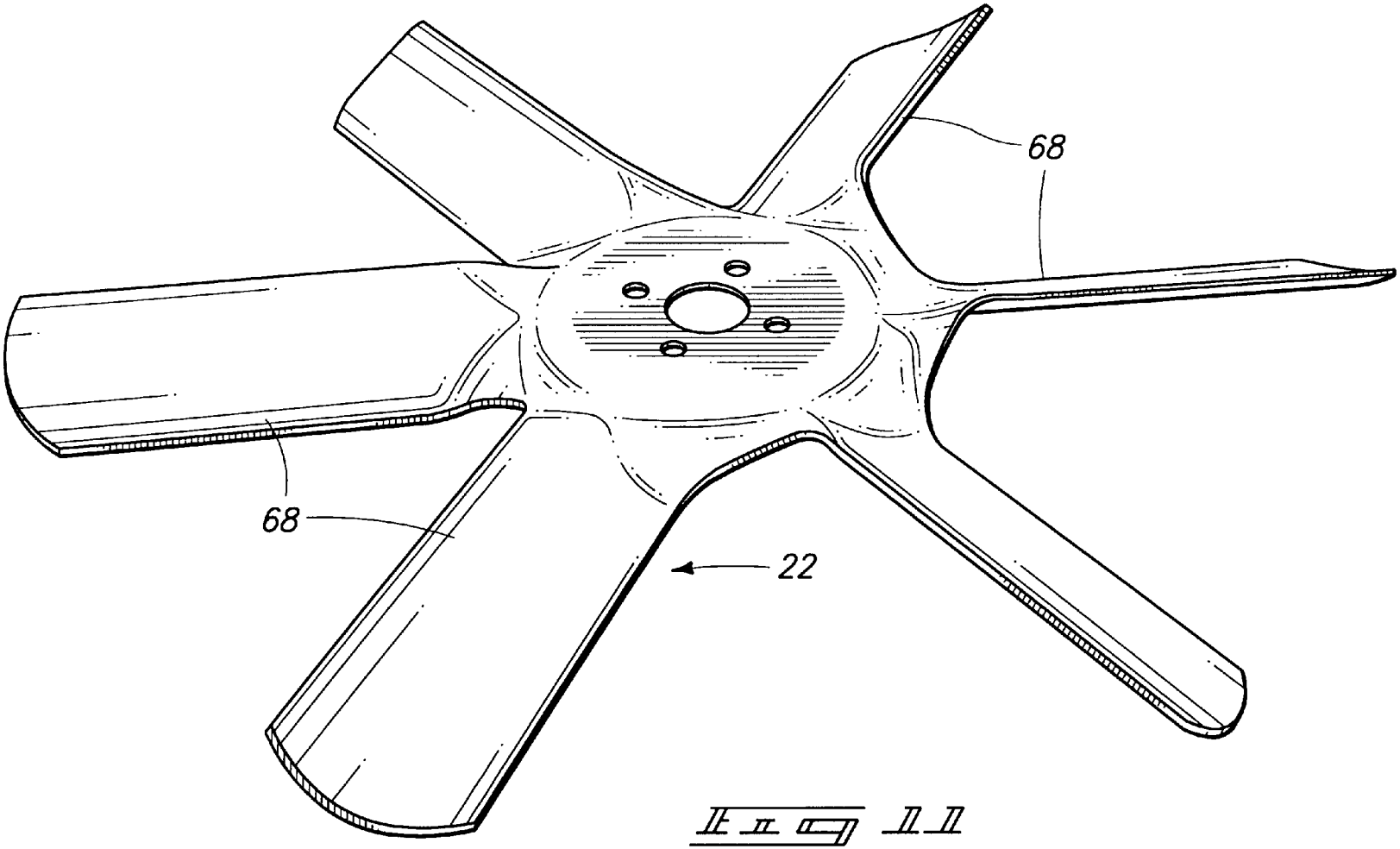

The enclosed airspace 30, in the embodiment illustrated in FIG. 10, is configured to enable filling with a flotation foam 31 to further assure buoyancy. In such embodiments, the selected foam material is preferably marine grade closed cell plastic foam that is typically used for flotation in boats. Use of closed cell foam assures a desired flotation level for the unit even if the outer linear polyethylene shell is pierced.

In preferred forms, the base 16 includes a substantially frusto-conical configuration substantially centered on the central axis X and having a reduced bottom end 32 situated toward the impeller 22 and an enlarged top end 34 adjacent the pontoons 17. It is most preferable that the reduced bottom end 32 be situated below the pontoons 17 as shown in FIGS. 2, 5, 7 and 10. It is a function of the frusto-conical base shape (at least the external wall parts extending below and between the pontoons 17) to direct current flow radially outward to the pontoons and into the wedge shaped spaces 24.

It is pointed out that the preferred frusto-conical base 16 is generally circular in cross section. However, other shapes may be used that could have an equivalent effect to direct current flow radially outward toward the pontoons 17. Therefore the term "frusto-conical" is hereby given broad meaning to include any three dimensional form that gene rally resembles an inverted cone. This would include, for example, a frustum of a regular pyramid or another appropriate tapered configuration at the intersection of the pontoons.

Figure 5:
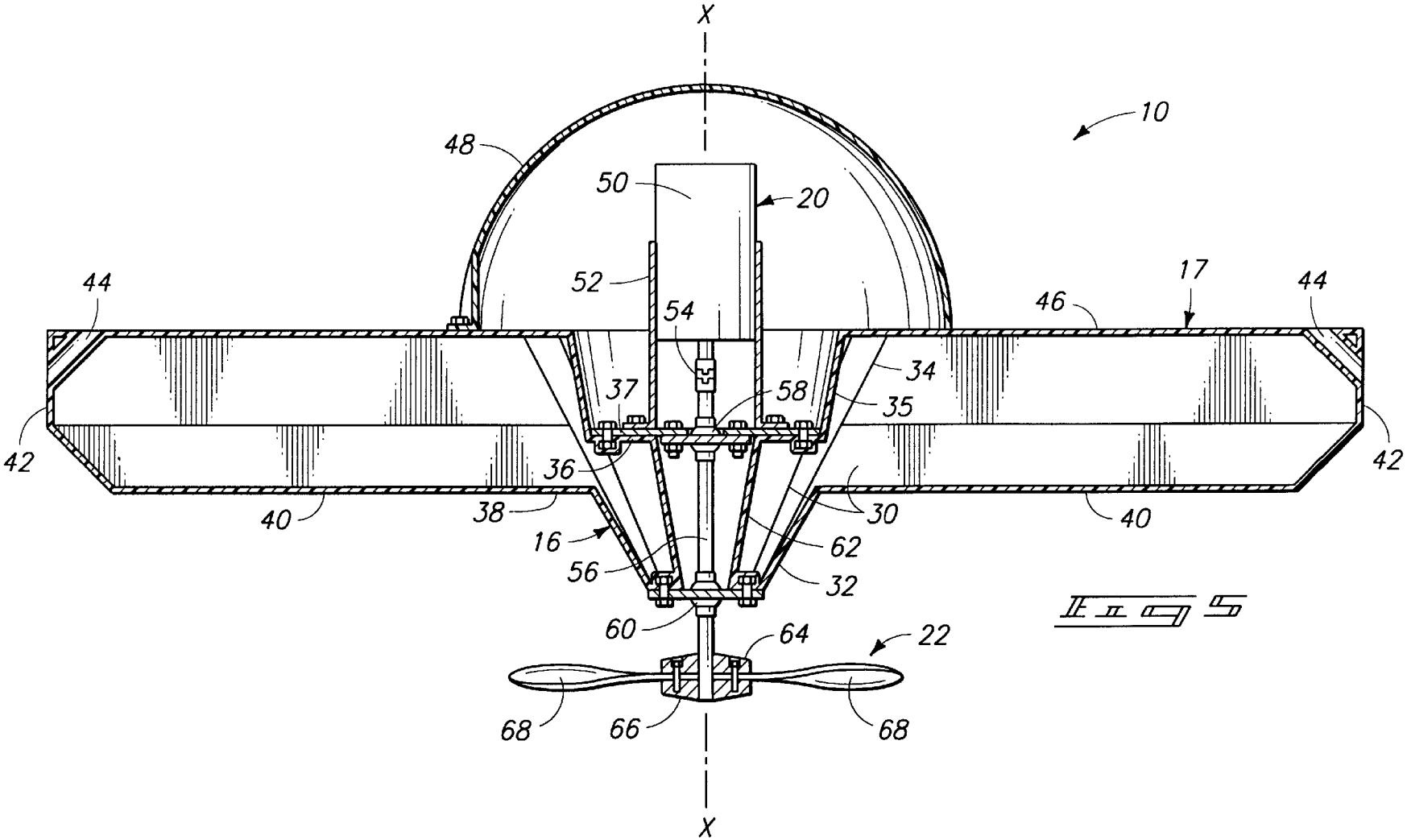
FIG. 5 is an enlarged sectional view taken substantially along line 5—5 in FIG. 3.

In the embodiment exemplified by FIG. 5, an indentation 35 leads to a motor mount surface 36 is formed in the top end of the base 16.

The motor mount surface 36 is an integral floor of the indentation 35, with provisions for mounting the drive mechanism 20. The indentation 35 is provided so the complete circulator system 10 with a drive mechanism 20 in place will present a low profile with little wind resistance and maximum stability when the unit is afloat.

It is preferred that the motor mount surface 36 be integral with the base and situated above the water line when the system is afloat. It is also preferred that the mount surface 36 be reinforced, advantageously by a stainless steel ring or "washer" 37 that may be bolted to the mount surface 36 along with the drive mechanism 20.

The embodiment illustrated by FIGS. 6–10 use a somewhat different mounting arrangement than that described above. FIG. 10, for example, shows an arrangement in which a mount surface 85 is flush with the top surface of the base and pontoons. Surface 85 is reinforced with a stainless steel plate 86 that may be bolted or otherwise secured to the top surface of the base and pontoons. This leaves an indented area 84 open to loosely receive an impeller drive shaft 105 which will be discussed in greater detail later on in this description.

The pontoons 17, as indicated above, are preferably formed integrally with the base 16. They radiate from the base preferably at equally spaced angles to afford stability while the system is floating on a pond surface, and to uniformly guide current in a generally radial outward direction. To afford such stability, it is preferred that there be at least three and more preferably six of the pontoons 17, with inward ends 38 joined integrally with the base 16.

It is advantageous that the pontoons each include a V-shaped hull configuration 40 that is substantially radial with respect to the central axis X. This particular hull configuration also helps, along with the remainder of the pontoon surfaces below the liquid surface, in directing the current produced by impeller 22.

Outward ends 42 of the pontoons 17 in the FIG. 1–5 embodiment are closed to maintain the closed airspace 30. At least two of the opposed ends 42 include an appropriate fastening eye 44 or another appropriate anchor point which will accept a guy cable or rope (not shown) that may be used to hold the system in a fixed location on the pond surface.

In the embodiment shown in FIGS. 6–10, the pontoons 17 include outer ends 91 that are downwardly disposed, forming upright legs 92. The legs are also integral with the pontoons 17 and extend to bottom leg ends 93 that are situated below the plane of the impeller 22 (see FIGS. 6 and 7). The bottom ends 93 are closed and provide support surfaces that function to hold the impeller elevated when the unit is resting on a floor or ground surface. This arrangement serves to protect the impeller and to allow the unit to be positioned in a self supporting upright position for maintenance or repair. Also, should a pond or lagoon be drained, or the liquid level be otherwise lowered, the leg ends 93 will first come into contact with the pond or lagoon bottom as the liquid level lowers. The legs may thus support the impeller above the pond bottom as the pond level drops.

The legs 92 also include wedge shaped inward facing V-shaped surfaces 94 (FIG. 8) that function somewhat similarly to the V-shaped hull configurations, to avoid disruption of outward substantially radial flow of liquid as imparted by the impeller 22, base 16, and the pontoons 18.

In both embodiments, the top edges of the pontoons and the base are covered by and integral with a deck surface 46 that is preferably flat and horizontal. In the embodiment shown by FIG. 10, the deck surface 46 is integral with and substantially coplanar with the mounting surface 85.

The deck surface 46, base 16, and pontoons 17 are all preferably integrated by the molding process and are therefore formed of the same material. They also define the closed interior airspace 30 which contributes to buoyancy of the complete system 10.

In the preferred embodiments, a dome shaped drive cover 48 is removably mounted to the top deck surfaces 46, covering the drive mechanism 20. The dome 48 may be semi-spherical as shown, or be constructed to present a configuration similar to a natural structure such as a stone if the system is to be used in public areas (such as golf course water traps) where aesthetics are a concern. In either configuration, the dome 48 may be formed of the same material as the base and pontoons. The dome 48 may be releasably secured to the deck 46 by conventional fasteners to protect the drive mechanism against weather.

In general, the drive mechanism 20 may be selected from various mechanisms that will produce desired rotation of the impeller 22. In the preferred forms, the drive mechanism 20 is comprised of an electric motor 50 that is controlled to produce a desired rotational rate for the impeller. This may be done by controlling current to the motor 50 and using a direct drive arrangement as exemplified in FIG. 5, or by providing a gear reduction unit 100 (FIG. 10). Either drive arrangement is conventional and commercially available.

It is desirable, however, that the output rpm be within a range of between approximately 80 and 200 rpm, to provide adequate circulation current and at the same time avoid cavitation at the impeller 22. Within the above range, a generally preferred rate for use If in manure and urine recycling ponds is more specifically between approximately 120 and 125 rpm. The rpm rate may be varied upwardly in thin liquids, or reduced in viscous liquids, but in either situation care is taken to avoid cavitation of the impeller. Cavitation will disrupt the desired torroidal flow pattern.

The motor size in terms of horsepower may also be selected in accordance with the consistency of the materials to be circulated. Horsepower ranges thus may vary considerably; for example from as little as approximately 0.1 horsepower for small bodies of water that are not heavily sedimented (such as small late stage waste treatment ponds), up to 5 horsepower or more (such as for use in large or heavily sedimented early stage waste treatment ponds).

It has been found that horsepower requirements may vary as noted, and may be increased or decreased as needed, but the rpm of the impeller should be held within a range in which cavitation of the impeller is avoided. This is contrary to numerous "aerators" that intentionally create cavitation in order to induce air in the liquid body. The present system instead makes use of liquid circulation in which liquid is drawn upwardly from the bottom of a pond or lagoon, and spread substantially radially from the unit across the surface where the liquid current is exposed to air. The result is that large volumes of liquid are exposed to air across a large surface area whereas other forms of aerators inject or bring air into the liquid, below the surface where only a small percentage of the liquid can become exposed to the air.

It is noted that other types of equivalent drive mechanisms may also be used. Examples include wind powered drives, battery powered motors (batteries being solar cell charged), or in some instances, gasoline, diesel, propane, or other fueled internal combustion engines.

The motor 50 in the embodiment illustrated by FIG. 5 is mounted by way of a mounting bracket 52 that is preferably secured by bolts directly to the motor mount 36 and steel ring 37 within the indentation 35. The bracket 52 elevationally positions the motor 50 well above the operational water line when the system is afloat.

The bracket 52 is preferably formed in accordance with the mounts provided on the motor 50, and is constructed using known technology of a corrosion resistant material such as stainless steel. In fact it is desirable that all parts (including fasteners) of the present system 10 be formed of corrosion resistant materials.

The output shaft of the motor 50 of the FIG. 5 embodiment is preferably connected to a conventional flexible coupling 54 which, in turn, mounts an impeller drive shaft 56. The drive shaft 56 is centered on the upright axis X by self aligning bearings 58, 60 which are commercially available and constructed of corrosion resistant materials. One bearing 58 is mounted by bolts to the motor mount 36 above the water line.

The shaft 56 is rotatably journalled by the bearing 58 and extends axially downward through a hollow, tubular core 62 of the base 16. The walls of the core 62 are integral with the motor mount 36 and the reduced bottom end 32 of the base, thereby maintaining the closed airspace 30.

It is noted that the bearings 58 need not be sealed to its housing and the shaft 56 since the motor mount 36 is preferably above the water line, as discussed above. In fact, it is preferred that there is not a seal between the bearing 58, motor mount 36 and shaft 56 so that any accumulated water or other liquid that might find its way into the base indentation 35 will drain through the tubular core 62.

The bottom bearing 60 may be substantially identical to the bearing 58, but mounts the shaft 56 to the reduced bottom end 32 of the base 16. The bottom bearing 60 is also used to journal the shaft 56 for rotation about the central axis X.

The shaft 56 extends on downwardly from the bottom bearing 60 to hubs 64, 66 that in both embodiments, secure the impeller for rotation with the shaft 56 or 105. The top one of the hubs 64 is preferably sweated, swaged, welded or otherwise secured for rotation with the shaft 56. The bottom one of the hubs 66 is provided with appropriate bolts or other fasteners for securing the impeller 22 in centered relation to the axis X. Both hubs 64, 66 may be made of corrosion resistant material such as aluminum.

Reference will now be made more specifically to the shaft and drive arrangement of the embodiment exemplified by FIGS. 6–10. Referring to FIG. 10, the motor 50 is shown connected to the gear reduction unit 100 which is a conventional gear reducer and need not be discussed in great detail. The gear reduction unit 100 is mounted by way of a mounting bracket 101 that is preferably secured by bolts directly to the motor mount 85 and steel plate 86 along the top deck surface 46 of the base and pontoons. The bracket 101 elevationally positions the motor 50 well above the operational water line when the system is afloat.

The bracket 101 is preferably formed in accordance with the mounts provided on the gear reduction unit 100, and is constructed, using known technology, of a corrosion resistant material such as stainless steel. The bracket 101 is formed in a relatively open configuration to allow visual inspection and access to the impeller drive shaft 105. A lift bale 102 projects upwardly through an appropriately placed slot in the dome 48 to facilitate lifting and maneuvering of the unit. A similar bale, though not shown, could also be provided on the mounting bracket 52 of the FIG. 1–5 embodiment.

The shaft 105 is mounted for rotation about the central axis X by the gear reduction unit 100 and by a bearing 107 mounted on the plate 86. Thus both shaft mounting bearing points are situated above the water line when the unit is floating on a pond or lagoon. The drive shaft 105 is centered on the upright axis X by the two mounting points and projects downwardly through the base to exit at the reduced bottom end 32 to a cone tip 108 that is affixed to the shaft between the reduced bottom 32 and the impeller 22.

The cone tip 108 may be manufactured using the same materials as the pontoons and base, and may be secured to the drive shaft 105 by set screws or equivalent fasteners. The cone tip 108 assists in guiding upward flow of liquid as imparted by the impeller, spreading the flow outwardly as it advances upward toward the base and pontoons.

The impeller 22 (FIG. 11) is preferably formed of a single stamped sheet, preferably of stainless steel. Variations of the impeller may be made in the number of blades, however, it has been found that an impeller having six integral, substantially equally spaced blades 68 (about the central axis X) functions well.

It is also preferable that the diameter of the impeller (between opposed blade tips) be similar to or slightly larger than the diameter of the base, and that the hubs 64, 66 be of diameters no larger than the reduced bottom end of the base. This is done so vortex current produced by the impeller will upwardly impinge on the frusto-conical walls of the base 16 and be deflected radially outwardly.

Figure 11:
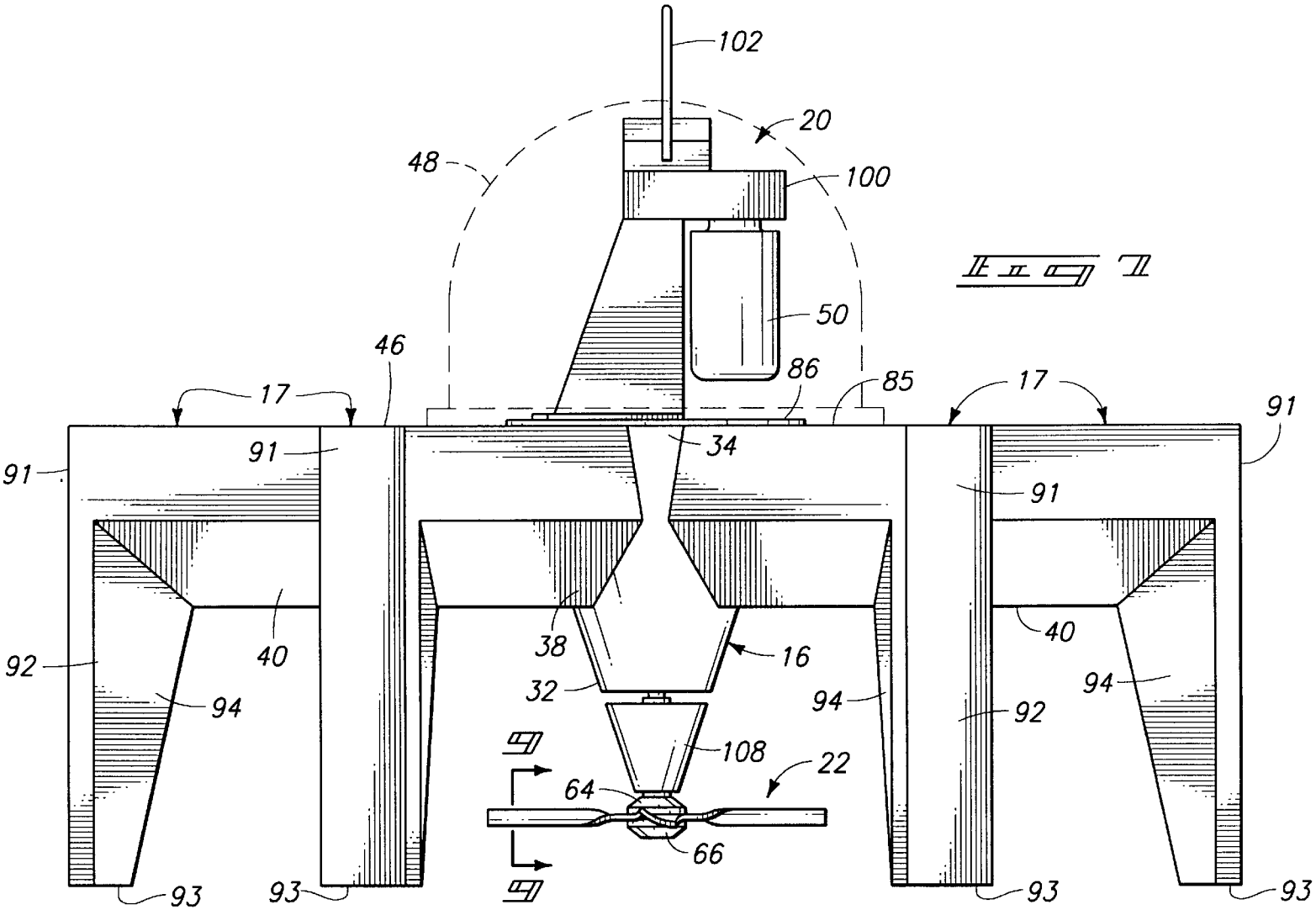
FIG. 11 is a perspective view of a preferred impeller.
Figure 8:
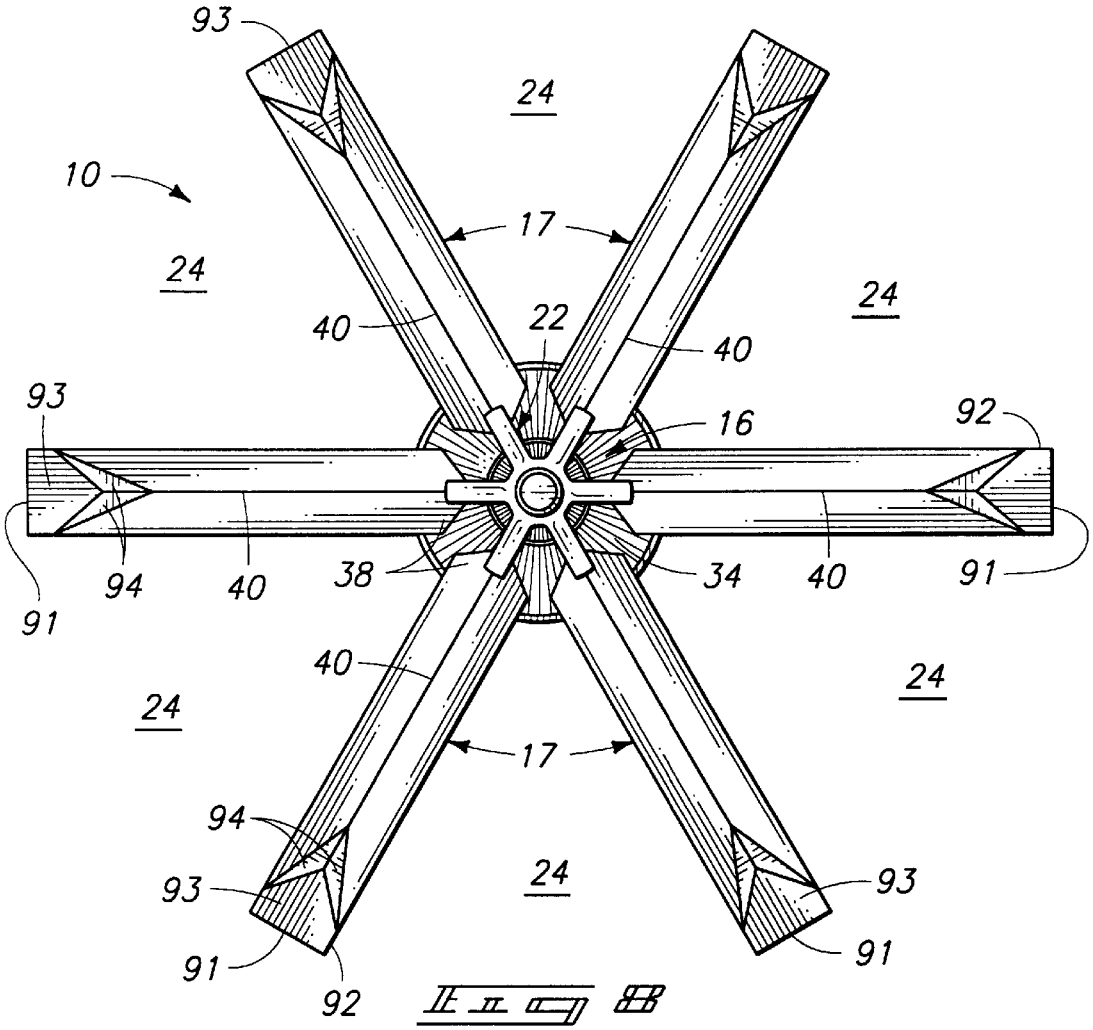
FIG. 8 is a reduced top plan view as seen from below in FIG. 7.
Figure 9:
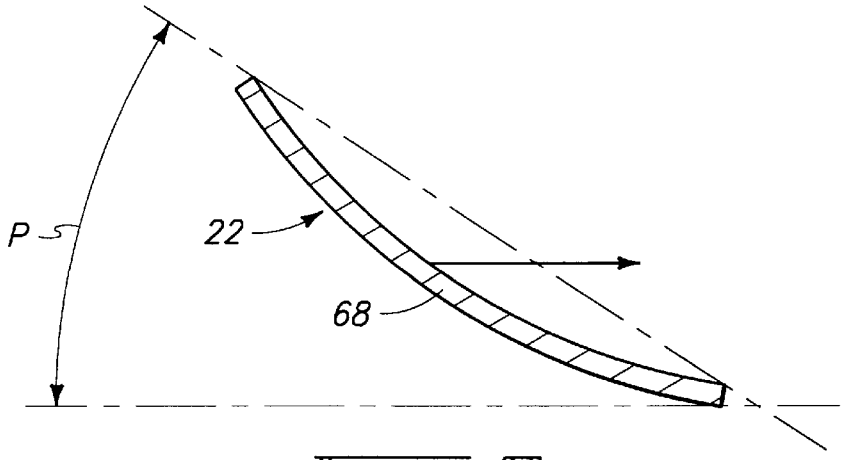
FIG. 9 is an enlarged sectional view of an impeller blade, taken substantially along line 9—9 in FIG. 7 and indicating the pitch thereof.

A specific impeller is exemplified in FIG. 11 that will function well in preferred embodiments of the invention. The impeller includes blades 68 that are set at substantially equal pitch angles, one of which is exemplified by FIG. 9. The pitch angle indicated at P is approximately 33° from a horizontal plane. This is within an operating range that is preferably between 15° and 40°. The selected pitch angle, coupled with the rotational speed is advantageous in producing the desired circulation of liquid in a torroidal shaped path substantially as indicated in FIGS. 2 and 6.

As In the circulatory path, liquids are drawn upwardly in somewhat of a vortex current induced by the rotating impeller. The liquids are then directed substantially radially outward by the pontoons and along the surface, exposing the liquid and suspended materials to the air. Finally, the outwardly moving liquids move back downwardly toward the pond or lagoon bottom where the cycle begins again.

It is also preferred that the rotational direction and blade pitch be consistent with natural hemispheric gravitational whirlpool effects. That is, rotation of the impeller should be matched with the natural direction of vortex rotation according to the global hemisphere in which the system is operating. Thus the impeller may be rotated clockwise in the northern hemisphere and counter-clockwise in the southern hemisphere and the pitch of the impeller will be formed accordingly.

Given the above description, operation of the preferred system may now be easily understood. Such operation will be discussed in terms of process steps for producing a cyclonic liquid flow in a standing body of liquid.

A first step in an exemplary preferred process involves floating the base 16 with the pontoons 17 extending substantially radially from the base on the body or pool of liquid, in such a manner that the pontoons engage the liquid and form wedge shaped spaces 24 between successive pontoons. This is preferably done with the base 16 and pontoons 17 secured in a selected stationary position on the surface of the selected pool by means of appropriate guy cables or ropes (not shown) that may be connected by conventional means to the fastening eyes 44.

The exemplified motor 50 is also connected to a source of electrical energy. If the motor is to be operated by conventional alternating current, appropriate electrical wire connections are made to the current source. Conventional switching (not shown) may also be incorporated in the circuit allowing on-off control. Conventional safety circuit breakers (also not shown) may also be used as a safety measure.

Now the impeller may be rotated about the central axis X to produce a vortex current of liquid directed upwardly toward the base 16. This is accomplished simply by activating the drive mechanism 20. The impeller 22 will rotate accordingly and the blades 68 will act to pull the liquid upwardly. The rotating blades will produce a vortex current 28 (FIGS. 2 and 6) that will pull materials in the pond upwardly from adjacent the bottom surface toward the top surface of the pond.

Another step may be that of directing the current received from the impeller substantially radially away from the base through the wedge shaped spaces 24. This is accomplished by the inverted frusto-conical shape of the base 16, and the radial pontoons 17. The upwardly flowing current impinges against the base and is deflected outwardly by the frusto-conical base walls. The current looses little of its upward momentum and thus continues movement toward the surface of the pond, but now has a somewhat outward radial component of movement.

Substantially radial flow is encouraged by the radial orientation of the pontoons 17, within the wedge shaped spaces 24 between successive pontoons 17. The current is thus guided substantially radially outward by the pontoons and across the surface of the pond in all directions about the axis X along the surface of the pond (FIG. 2).

The radially outwardly flowing current will be exposed to oxygen in the adjacent air, and will become oxygenated, thus providing life support for aerobic bacteria which in turn thrive on organic materials carried in the current. Aerobic activity will continue so long as there are organic materials and oxygen for survival. Since the materials continue to be drawn into the current flow, and since oxygenation will continue to occur, organic materials drawn into the current will eventually be consumed without need for anaerobic decomposition.

The liquid current will eventually lose its outward impetus and In descend, due to the upward draw continuously produced by the impeller which thereby displaces liquid from the bottom of the pond. At least some of the same materials suspended within the liquid will therefore migrate back to the center of vortex flow and be drawn upwardly again in the current where re-oxygenation will occur. Other materials will be drawn from adjacent areas and eventually become oxygenated in the re-circulating current flow. In effect the current flow is axially torroidal.

The pontoons, base, and impeller thus produce the substantially torroidal shaped re-circulating current flow with substantially radial components of such flow occurring along the liquid surface and adjacent the pond bottom, a substantially axial upward component along the central axis, and a substantially axial downward component spaced radially outward of the pontoons. The current in the radial component at the top surface of the pond is exposed to air and the aerobic bacteria in the liquid are sustained by such exposure. Aerobic activity occurs as the current circulates through the downward component and eventually across the bottom toward the central axis to the vortex current where it is lifted again and deflected outwardly across the surface where it is re-exposed to life sustaining oxygen.

Because there is little or no anaerobic decomposition, little if any noxious gasses will be produced. Also, since aerobic bacteria work four to six times faster in the same conditions as anaerobic bacteria, smaller ponds may be used, or organic waste input to the pond may be increased.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis;

wherein the base and pontoons are configured to rest on a pond including a liquid surface and a pond bottom with the pontoons engaging the liquid surface and forming wedge shaped spaces between successive pontoons;

wherein the impeller is configured to be rotated by the drive mechanism about the central axis to produce a vortex current of liquid directed toward the base and the liquid surface;

wherein pontoons, base, and impeller are configured to form a substantially torroidal shaped re-circulating current flow with substantially radial components of such flow occurring along the liquid surface and adjacent the pond bottom, a substantially axial upward component along the central axis, and a substantially axial downward component spaced radially outward of the pontoons and wherein at least some of the pontoons include legs that project axially from said at least some pontoons to leg ends that are spaced radially from the central axis and disposed axially such that the impeller is situated axially between the leg ends and the pontoons.

2. The waste pond liquid circulator of claim 1 wherein the pontoons are integral with the base.

3. The waste pond liquid circulator of claim 1 wherein the pontoons are oriented substantially normal to the central axis.

4. The waste pond liquid circulator of claim 1 wherein the pontoons each include a V-shaped hull configuration that is substantially radial with respect to the central axis.

5. The waste pond liquid circulator of claim 1 wherein the base includes a substantially frusto-conical configuration substantially centered on the central axis and having a reduced bottom end situated toward the impeller and an enlarged top end adjacent the pontoons.

6. The waste pond liquid circulator of claim 1 wherein the base includes a substantially frusto-conical configuration substantially centered on the central axis and integral with the pontoons.

7. The waste pond liquid circulator of claim 1 wherein the impeller is formed of a stamped sheet metal and includes blades substantially equally spaced about the central axis.

8. The waste pond liquid circulator of claim 1 wherein the base includes a substantially frusto-conical configuration substantially centered on the central axis and including an enlarged top end and a reduced bottom end; and wherein the impeller includes a diameter that is at least equal to the dimension across the enlarged top end of the base.

9. The waste pond liquid circulator of claim 1 further comprising a dome configured to cover the drive mechanism.

10. The waste pond liquid circulator of claim 1 wherein the pontoons include top deck surfaces and bottom V-shaped hull surfaces; and wherein the base is of an inverted substantially frusto-conical configuration with a reduced bottom end and an enlarged top end; and wherein the reduced bottom end projects below the bottom V-shaped hull surfaces.

11. The waste pond liquid circulator of claim 1 wherein the pontoons include top deck surfaces and bottom V-shaped hull surfaces; and a dome shaped drive cover removably mounted to the top deck surfaces covering the drive mechanism.

12. A liquid waste pond circulator, comprising:

a base including a substantially frusto-conical configuration substantially centered on a central axis and having a reduced bottom end and an enlarged top end;

a plurality of pontoons formed integrally with the base and arranged to extend substantially radially from the base with respect to the central axis;

a drive mechanism on the base;

a drive shaft extending substantially coaxial with the central axis from the drive mechanism through the reduced bottom end of the base;

an impeller mounted on the drive shaft and situated below the reduced bottom end of the base for rotation about the central axis responsive to operation of the drive mechanism;

wherein the impeller includes blades that are set at a pitch angle of between approximately 15° and 40°;

wherein the drive mechanism is configured to rotate the impeller at a rate of between approximately 80 and 200 rpm;

wherein the base and pontoons are configured to float on a liquid surface with the pontoons engaging the liquid and forming wedge shaped spaces between successive pontoons;

wherein the impeller is configured to be rotated by the drive mechanism about the central axis to produce a vortex current of liquid directed upwardly toward the base; and wherein the base and pontoons are configured to direct the current substantially radially away from the base through the wedge shaped spaces.

13. The waste pond liquid circulator of claim 12 wherein the impeller is formed of a stamped sheet and includes six integral blades substantially equally spaced about the central axis.

14. The waste pond liquid circulator of claim 12 wherein the base includes a substantially frusto-conical configuration substantially centered on the central axis and including an enlarged top end and a reduced bottom end; and wherein the impeller includes a diameter that is at least equal to the dimension across the enlarged top end of the base.

15. The waste pond liquid circulator of claim 12 further comprising a dome configured to cover the drive mechanism.

16. The waste pond liquid circulator of claim 12 wherein the pontoons each include a V-shaped hull configuration that is radial with respect to the central axis.

17. A process for producing recirculating liquid flow in a standing body of liquid, comprising the steps of:

floating a base with pontoons extending substantially radially from the base on the body of liquid with the pontoons engaging the liquid and forming wedge shaped spaces between successive pontoons;

rotating an impeller about the central axis to produce a vortex current of liquid directed upwardly toward the base; and directing the current substantially radially away from the base through the wedge shaped spaces.

18. The process of claim 17 wherein the step of directing the current substantially radially away from the base through the wedge shaped spaces is accomplished by:

impinging the vortex current against the base to deflect the current upwardly and outwardly toward the pontoons; and guiding the current along the pontoons substantially radially outwardly.

19. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis and having blades set at a predetermined pitch angle;

wherein the base and pontoons are configured to rest on a pond including a liquid surface and a pond bottom with the pontoons engaging the liquid surface and forming wedge shaped spaces between successive pontoons and with the impeller situated below the liquid surface;

wherein the impeller is configured to be rotated by the drive mechanism about the central axis to produce a vortex current of liquid directed toward the base and the liquid surface; and wherein the pontoons, base, and impeller are configured to form a substantially torroidal shaped re-circulating current flow with substantially radial components of such flow occurring along the liquid surface and adjacent the pond bottom, a substantially axial upward component along the central axis, and a substantially axial downward component spaced radially outward of the pontoons.

20. A liquid waste pond circulator, comprising:

a base including a substantially frusto-conical configuration substantially centered on a central axis and having a reduced bottom end and an enlarged top end;

a plurality of pontoons formed integrally with the base and arranged to extend substantially radially from the base with respect to the central axis;

a drive mechanism on the base;

a drive shaft extending substantially coaxial with the central axis from the drive mechanism through the reduced bottom end of the base;

an impeller with blades set at a pre-determined pitch angle and mounted on the drive shaft below the reduced bottom end of the base for rotation about the central axis responsive to operation of the drive mechanism;

wherein the base and pontoons are configured to float on a liquid surface with the pontoons engaging the liquid and forming wedge shaped spaces between successive pontoons;

wherein the impeller is configured to be rotated by the drive mechanism about the central axis to produce a vortex current of liquid directed upwardly toward the base; and wherein the base and pontoons are configured to direct the current substantially radially away from the base through the wedge shaped spaces.

21. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis;

wherein the base and pontoons are configured to rest on a pond including a liquid surface and a pond bottom with the pontoons engaging the liquid surface and forming wedge shaped spaces between successive pontoons;

wherein the impeller is configured to be rotated by the drive mechanism about the central axis to produce a vortex current of liquid directed toward the base and the liquid surface;

wherein the pontoons, base, and impeller are further configured to form a substantially torroidal shaped re-circulating current flow with substantially radial components of such flow occurring along the liquid surface and adjacent the pond bottom, a substantially axial upward component along the central axis, and a substantially axial downward component spaced radially outward of the pontoons;

wherein the pontoons include V-shaped hull configurations that are substantially radial with respect to the central axis;

legs that project axially from said at least some pontoons to leg ends that are spaced radially from the central axis and disposed axially such that the impeller is situated axially between the leg ends and the pontoons; and wherein the legs include axial V-shaped surfaces facing the central axis.

22. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis;

wherein the base and pontoons are configured to rest on a pond including a liquid surface and a pond bottom with the pontoons engaging the liquid surface and forming wedge shaped spaces between successive pontoons;

wherein the impeller is configured to be rotated by the drive mechanism about the central axis to produce a vortex current of liquid directed toward the base and the liquid surface;

wherein the pontoons, base, and impeller are further configured to form a substantially torroidal shaped re-circulating current flow with substantially radial components of such flow occurring along the liquid surface and adjacent the pond bottom, a substantially axial upward component along the central axis, and a substantially axial downward component spaced radially outward of the pontoons;

wherein the base includes a substantially frusto-conical configuration substantially centered on the central axis; and a cone tip connected to the drive mechanism between the base and impeller.

23. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis;

wherein the base and pontoons are configured to rest on a pond including a liquid surface and a pond bottom with the pontoons engaging the liquid surface and forming wedge shaped spaces between successive pontoons;

wherein the impeller is configured to be rotated by the drive mechanism about the central axis to produce a vortex current of liquid directed toward the base and the liquid surface;

wherein the pontoons, base, and impeller are further configured to form a substantially torroidal shaped recirculating current flow with substantially radial components of such flow occurring along the liquid surface and adjacent the pond bottom, a substantially axial upward component along the central axis, and a substantially axial downward component space_ radially outward of the pontoons; and wherein the impeller includes blades that are set at a pitch angle of between approximately 15° and 40°.

24. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis;

wherein the base and pontoons are configured to rest on a pond including a liquid surface and a pond bottom with the pontoons engaging the liquid surface and forming wedge shaped spaces between successive pontoons;

wherein the impeller is configured to be rotated by the drive mechanism about the central axis to produce a vortex current of liquid directed toward the base and the liquid surface;

wherein the pontoons, base, and impeller are further configured to form a substantially torroidal shaped recirculating current flow with substantially radial components of such flow occurring along the liquid surface and adjacent the pond bottom, a substantially axial upward component along the central axis, and a substantially axial downward component spaced radially outward of the pontoons; and wherein the impeller includes blades that are set at a pitch angle of between approximately 15° and 40°, and wherein the drive mechanism is configured to rotate the impeller at between approximately 80 and 200 rpm.

25. A waste pond liquid circulator, comprising:

a base;

a plurality of pontoons connected to the base and arranged to extend substantially radially with respect to a central axis passing through the base;

a drive mechanism on the base;

an impeller connected to the drive mechanism for rotation about the central axis;

wherein the base and pontoons are configured to rest on a pond including a liquid surface and a pond bottom with the pontoons engaging the liquid surface and forming wedge shaped spaces between successive pontoons;

wherein the impeller is configured to be rotated by the drive mechanism about the central axis to produce a vortex current of liquid directed toward the base and the liquid surface;

wherein the pontoons, base, and impeller are further configured to form a substantially torroidal shaped re-circulating current flow with substantially radial components of such flow occurring along the liquid surface and adjacent the pond bottom, a substantially axial upward component along the central axis, and a substantially axial downward component spaced radially outward of the pontoons; and wherein the drive mechanism is configured to rotate the impeller at a rate of between approximately 80 and 200 rpm.

* * * * *

UNITED STATES PATENT AND TRADEMARK OFFICE

CERTIFICATE OF CORRECTION

PATENT NO. : 6,241,221 B1
DATED : June 5, 2001
INVENTOR(S) : Gary L. Wegner et al.

It is certified that error appears in the above-identified patent and that said Letters Patent is hereby corrected as shown below:

Title page,
ABSTRACT, third line from the bottom, replace "toward the it base." with -- toward the base --.

Column 7,
Line 4, delete "As".

Column 8,
Line 12, replace "and In descend" with -- and descend --.

Column 13,
Line 7, replace "space__" with -- spaced --.

Signed and Sealed this

Fifteenth Day of January, 2002

*Attest:*

*Attesting Officer*

JAMES E. ROGAN
*Director of the United States Patent and Trademark Office*